US008790123B2

(12) United States Patent
Ku et al.

(10) Patent No.: US 8,790,123 B2
(45) Date of Patent: Jul. 29, 2014

(54) POWER SOCKET AND ELECTRONIC DEVICE HAVING THE SAME

(75) Inventors: Wuming Ku, Taoyuan Hsien (TW); Lexing He, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 137 days.

(21) Appl. No.: 13/532,531

(22) Filed: Jun. 25, 2012

(65) Prior Publication Data

US 2013/0164957 A1 Jun. 27, 2013

(30) Foreign Application Priority Data

Dec. 22, 2011 (CN) ..... 2011 1 0436061

(51) Int. Cl.
*H01R 4/66* (2006.01)
*H01R 13/648* (2006.01)

(52) U.S. Cl.
USPC ..... 439/95; 439/106

(58) Field of Classification Search
USPC ..... 439/95, 106, 607.28, 939
See application file for complete search history.

(56) References Cited

U.S. PATENT DOCUMENTS

| | | | | |
|---|---|---|---|---|
| 3,500,284 | A * | 3/1970 | Liberman | 439/106 |
| 6,893,274 | B2 * | 5/2005 | Chen et al. | 439/106 |
| 6,997,723 | B2 * | 2/2006 | Lee | 439/92 |
| 7,731,511 | B2 * | 6/2010 | Craig | 439/95 |

* cited by examiner

*Primary Examiner* — Hae Moon Hyeon
(74) *Attorney, Agent, or Firm* — Morris, Manning & Martin, LLP; Tim Tingkang Xia, Esq.

(57) ABSTRACT

A power socket disposed on a power supply casing of the electronic device to provide power for the electronic device through a power cord is disclosed. The power socket includes an insulating body, three input end contacts disposed at first side of the insulating body, three output end contacts including a grounding contact disposed at second side of the insulating body, and a rigid connector connected between the grounding contact and a protective grounding pin of the power supply casing. The invention simplifies the connection between the power socket and the power supply casing, thereby simplifies the manufacturing process of the power socket and eliminating the potential safety hazard.

14 Claims, 6 Drawing Sheets

POWER SOCKET AND ELECTRONIC DEVICE HAVING THE SAME

CROSS REFERENCE TO RELATED APPLICATIONS

This application claims priority to the Chinese patent application No. 201110436061.9, filed on Dec. 22, 2011, which is incorporated herein by reference in its entirety.

FIELD OF THE INVENTION

The invention relates to a power socket device and, more particularly, to a power socket and an electronic device having the same.

DESCRIPTION OF THE RELATED ART

In the related prior art, a power supply is provided in an electronic device casing for receiving the external electrical power and providing suitable current and voltage to the electronic device. A casing of the power supply is fixed to a casing of the electronic device, and the power supply socket is provided on the power supply casing and then connected to the external power supply via a power cord.

As shown in FIG. 1 and FIG. 2, the conventional power socket includes an insulating body 1, an input end contact (not shown) and output end contacts 31, 32 and 33. The output end contact 31, referred as the grounding contact 31 hereinafter, is electrical connected to the ground.

The insulating body 1 includes a back plate 12, a first body 11 disposed at one side of the back plate 12 and a second body 13 at the other side of the back plate 12. Two ends of the back plate 12 are formed with screw holes 14 for fixing the power socket to the power supply casing.

The input end contact is disposed in a recess of the first body 11, and the output end contacts 31, 32, 33 arranged in a triangle shape are protruded from the surface of the second body 13. In the insulating body 1, each of the input end contact is electrically connected to the corresponding output end contact. The input end contact is electrically connected to the power cord for receiving power from the external power supply. The grounding contact 31 is connected to a protective grounding pin of the casing of the electronic device through the connecting wire 51, and the output end contacts 32 and 33 are connected to a circuit board via the connecting wires 52 and 53 for supplying power to the electronic device.

However, the conventional power socket has the following defects.

To use the electronic device safely, the grounding contact 31 should be connected to the protective grounding pin of the power supply casing via the connecting wire 51. The first end of the connecting wire 51 is welded to the grounding contact 31, and the second end of the connecting wire 51 is formed with a round hole 54 through which a screw goes for locking the second end to the protective grounding pin of the power supply casing. Thereby the grounding contact 31 is electrically conducted with the grounding end of the power supply casing.

To reduce the electromagnetic radiation and electromagnetic interference, a shielding case 2 is usually disposed on the power socket. The shielding case 2 includes an inverted U-shaped shielding case body 21 and two connecting portions 22 at two sides of the shielding case body 21. The connecting portions 22 are connected to the back plate 12 of the insulating body 1, with the shielding case body 21 covering the second body 13 of the insulating body 1. The middle front portion of the shielding case body 21 extends downwards to form an extending portion 23, and the end of the extending portion 23 is provided with an inverted U-shaped portion 24 to be welded to the grounding contact 31.

The connecting wire 51 is usually a split conductor (multi-core wire), and the grounding contact 31 is a copper sheet. As a result, the first end of the connecting wire 51 and the inverted U-shaped portion 24 of the shielding case 2 should be hook-welded to the grounding contact 31. Due to the limitation of the hook-welding process, the connection between the first end, the U-shaped portion 24 and the grounding contact 31 is apt to break down, thereby generating potential safety hazard.

To meet the safety requirement of the power socket and avoid short circuit or interference with other elements in the power supply, the connecting wires 51, 52 and 53 need additional protection. Thus, the connecting wires 51, 52 and 52 should be sleeved with PVC tubes of different colors and then bundled into a cable, which leads to complex operation and high manufacturing cost.

As a result, it is required to develop a power socket to overcome the drawbacks in the conventional power socket, thereby simplifying the connection between the grounding contact of the power socket and the protective grounding pin of the power supply casing, simplifying the manufacturing process of the power socket and eliminating the potential safety hazard.

BRIEF SUMMARY OF THE INVENTION

One objective of the invention is to provide a power socket with a connector between a grounding contact of the power socket and a casing of a power supply, which simplifies the connection between the grounding contact of the power socket and the protective grounding pin of the power supply casing, simplifies the manufacturing process of the power socket, eliminates potential safety hazard.

Another objective of the invention is to provide an electronic device with the power socket above.

To solve the problem above, one embodiment of the invention provides a power socket, disposed on a power supply casing of an electronic device for providing power for the electronic device through a power cord. The power socket includes an insulating body; three input end contacts, disposed at first side of the insulating body; three output end contacts including a grounding contact, disposed at second side of the insulating body; and a rigid connector, being connected between the grounding contact and a protective grounding pin of the power supply casing.

To solve the problems above, another embodiment of the invention provides an electronic device having the above power socket.

The advantage of the invention is that a rigid connector socket takes place of the conventional flexible connecting wire between the grounding contact of the power socket and the power supply casing, which simplifies the connection between the grounding contact of the power socket and the protective grounding pin of the power supply casing, avoids the tying and sleeving and selecting the colors of the PVC tube, omits hook-welding processes, and simplifies the manufacturing process of the power socket. At the same time, the rigid connector avoids short circuit or interference with other elements, there is no need for additional protection. Further the riveting connection or the welding connection between the rigid connector and the grounding contact eliminate the potential safety hazard of the hook-welding.

Figure 1:
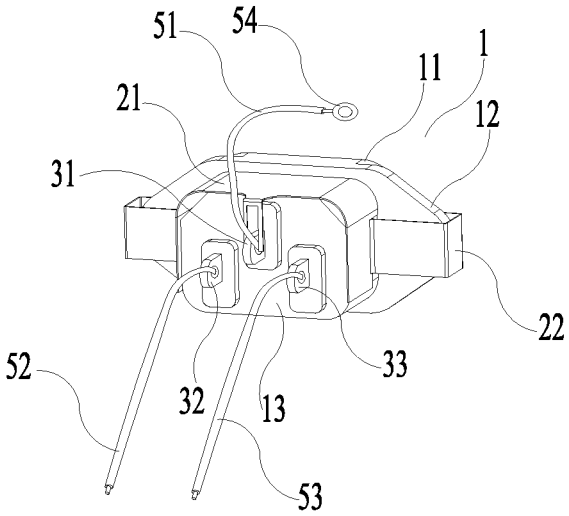
FIG. 1 (PRIOR ART)
FIG. 1 is a schematic view showing the structure of the power socket in the prior art.
Figure 2:
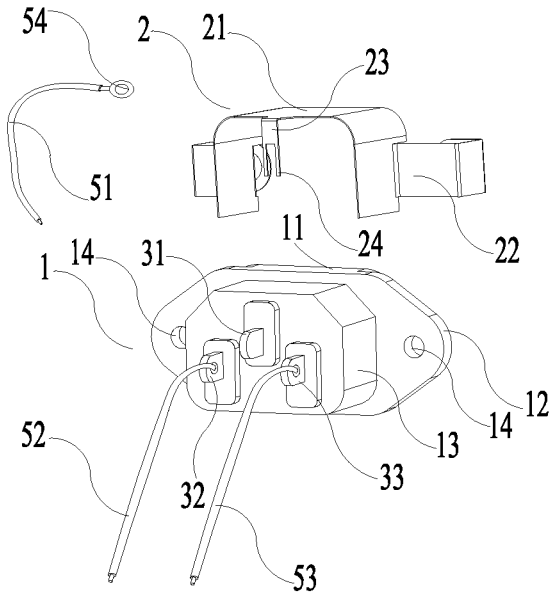
FIG. 2 (PRIOR ART)
FIG. 2 is an exploded perspective view of the power socket shown in FIG. 1.
Figure 3:
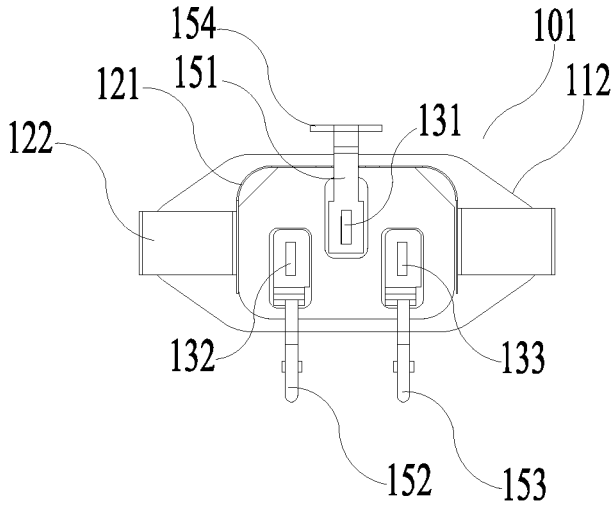
FIG. 3 is a front view showing the power socket in the first embodiment of the invention.
Figure 4:
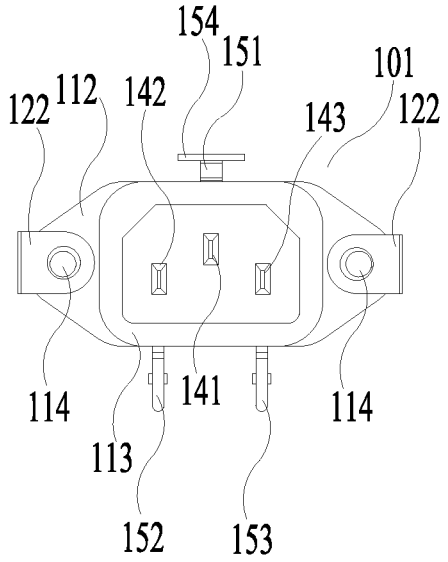
FIG. 4 is a rear view showing the power socket in the first embodiment of the invention.
Figure 5:
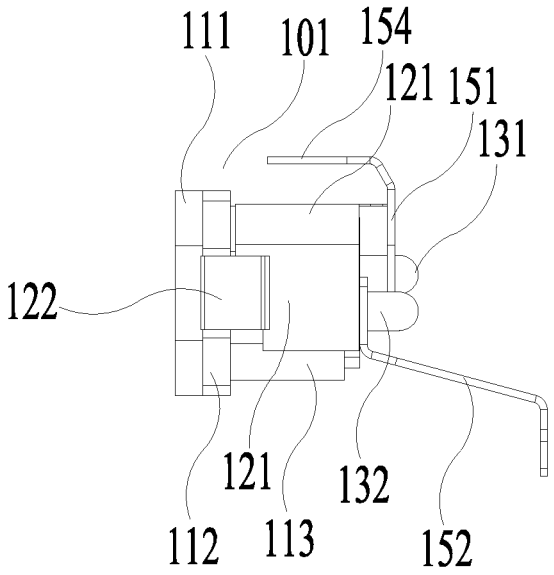
FIG. 5 is a left view showing the power socket in the first embodiment of the invention.
Figure 6:
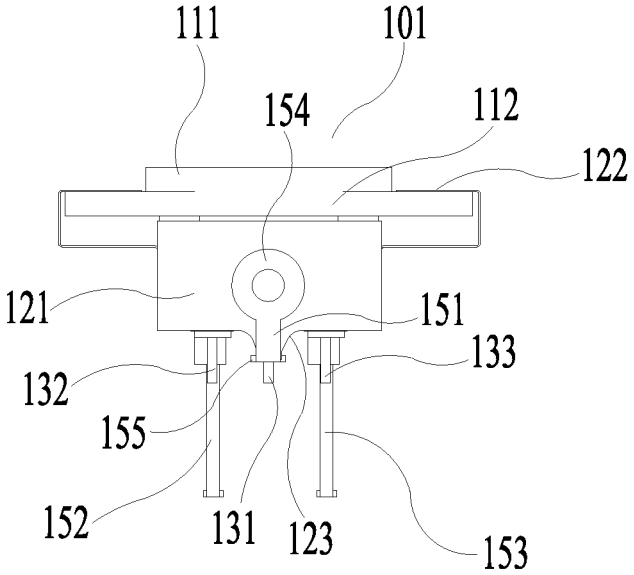
FIG. 6 is a top view showing the power socket in the first embodiment of the invention.

The reference numerals in the abovementioned drawings are shown hereinbelow.

| | |
|---|---|
| 1: insulating body | 11: first body |
| 12: back plate | 13: second body |
| 14: screw hole | 2: shielding case |
| 21: shielding case body | 22: connecting portion |
| 23: extending portion | 24: U-shaped portion |
| 31: output end contact (grounding contact) | 32: output end contact |
| 33: output end contact | 51: connecting wire |
| 52: connecting wire | 53: connecting wire |
| 54: opening | 101: insulating body |
| 111: first body | 112: back plate |
| 113: second body | 114: screw hole |
| 102: shielding case | 121: shielding case body |
| 122: connecting portion | 123: extending portion |
| 131: output end contact (grounding contact) | 132: output end contact |
| 133: output end contact | 141: input end contact |
| 142: input end contact | 143: input end contact |
| 151: rigid connector | 152: connector |
| 153: connector | 154: second end |
| 155: first end | 201: insulating body |
| 211: first body | 212: back plate |
| 213: second body | 214: screw hole |
| 202: shielding case | 221: shielding case body |
| 222: connecting portion | 223: extending portion |
| 224: U-shaped portion | 231: grounding contact |
| 232: output end contact | 233: output end contact |
| 251: rigid connector | 252: connector |
| 253: connector | 254: second end |
| 255: first end | 301: insulating body |
| 311: first body | 312: back plate |
| 313: second body | 314: screw hole |
| 302: shielding case | 321: shielding case body |
| 322: connecting portion | 330: grounding contact mounting hole |
| 331: grounding contact | 332: output end contact |
| 333: output end contact | 351: rigid connector |
| 352: connector | 353: connector |
| 354: first end | 355: second end |

DETAILED DESCRIPTION OF THE EMBODIMENTS

Hereinafter, the embodiments are described along with the accompanying drawing. It is to be understood that the terms used therein are just illustrative and exemplary rather than restrictive. Since the invention can be applied in various forms without departing from the spirit or principle of the invention, it is to be understood that the abovementioned embodiments will not be limited to any specific details mentioned above, rather, they should be construed broadly in the spirit or concept of the invention defined by the appended claims. Therefore, the present invention aims to cover all the modifications or variations falling within the protection scope defined by the appended claims.

An electronic device in an embodiment of the invention includes a power socket in the embodiment, and the electronic device in this invention may be, but not limited to, a computer, a router or a switch. That is, any electronic device provided with a power supply inside and supplied by an external power supply is involved in this invention.

The power sockets are illustrated hereinbelow by the following three embodiments.

The power socket in the first embodiment:

As shown in FIGS. 3 to 8, the power socket in the first embodiment of the invention includes an insulating body 101, input end contacts 141, 142 and 143, and output end contacts 131, 132 and 133. The output end contact 131 is connected to the grounding, which is also called the grounding contact 131.

The insulating body 101 includes a back plate 112, a first body 111 disposed at one side of the back plate 112 and a second body 113 disposed at the other side of the back plate 112. Screw holes 114 are defined at two ends of the back plate 112 for fixing the power socket to the power supply casing.

The input end contacts 141, 142 and 143 are disposed in the recess of the first body 112 in a triangle arrangement. The output end contacts 131, 132 and 133 protrude from the surface of the second body 113 in a triangle arrangement. Each input end contact is electrically connected to the corresponding output end contact inside the insulating body 101. The input end contacts 141, 142 and 143 are made of copper sheet and electrically connected to the power cord for receiving power from the external power supply. The grounding contact 131 is connected to the protective grounding pin of the power supply casing through a rigid connector 151, and the output end contacts 132 and 133 are connected to the circuit board through connectors 152 and 153, respectively, for supplying power to the electronic device. The connectors 152 and 153 may be rigid connectors or flexible connecting wires.

Figure 7:
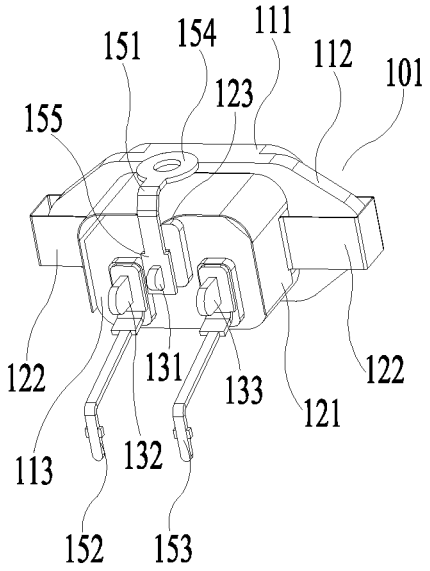
FIG. 7 is a perspective view showing the power socket in the first embodiment of the invention.
Figure 8:
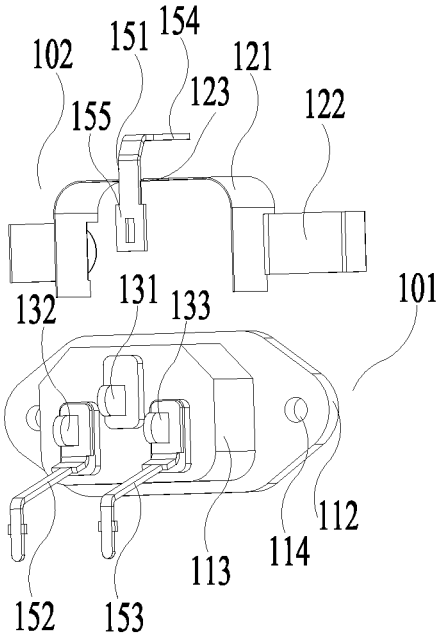
FIG. 8 is an exploded perspective view showing the power socket in the first embodiment of the invention.

As shown in FIG. 7 and FIG. 8, the grounding contact 131 is connected to the protective grounding pin of the power supply casing via the rigid connector 151, with a first end 155 thereof welded or riveted to the grounding contact 131, which improves the connection reliability between the rigid connector 151 and the grounding contact 131. A round hole, through which a screw goes, is defined at a second end 154 of the rigid connector 151, and a protrusion with a hole is extended from the protective grounding pin of the power supply casing, so that the second end 154 of the rigid connector 151 can be fixed to the protrusion via screw bolt and nut, thereby achieving the electric connection between the grounding contact 31 and the protective grounding pin of the power supply casing.

The rigid connector 151 is made of conductive material, preferably tinplate, wherein the tinplate is also called electrolytic tinplate, i.e., a cold-rolling low-carbon steel sheet or steel strip coated with commercial pure tin. The tin material can avoid corrosion and rustiness. The tinplate benefits from both the steel and the tin, with the steel advantages of high rigid and high plasticity, and the tin advantages of corrosion resistance, solderability and artistry. Therefore, the tinplate is a material with corrosion resistance, non-toxicity, high strength and good ductility.

The rigid connector 151 can be extended upwards from the grounding contact 131 and then horizontally to the protective grounding pin of the power supply casing in a right-angled form or any other suitable form, which is not limited in the present invention. The rigid connector 151 and the grounding contact 131 also may be integrated with each other.

As shown in FIG. 7 and FIG. 8, the power socket in the first embodiment of the invention further includes a shielding case 102, which includes an inverted U-shaped shielding case body 121 and two connecting portions 122 at two sides of the shielding case body 121. The connecting portions 122 are connected to the back plate 112 of the insulating body 101 with the shielding case body 121 covering the second body 113 of the insulating body 101. The shielding case 102 may be omitted in the power socket of the invention.

As shown in FIG. 8, in the first embodiment of the power socket, the shielding case 102 and the rigid connector 151 are made of the same material. The shielding case 102 may be integrated with the rigid connector 151, by welding an extending portion 123 bent from the middle of the shielding case body 121 outwards and downwards with the rigid connector 151, or by utilizing a double-layer structure at the first end 155 or the second end 154. That is, the middle of the shielding case body 121 extends downwards and then backwards to form a double-layer first end 155 of the rigid connector 151, and continually extends upwardly to form a single-layer second end 154 of the rigid connector 151. Alternatively, the middle of the shielding case body 121 extends upwards and then backwards to form a double-layer second end 154 of the rigid connector 151, and continually extends downwards to form a single-layer first end 155 of the rigid connector 151. As a result, the rigid connector 151 and the shielding case 102 can be manufactured from one piece of plate, and there is no need to weld the rigid connector 151 with the shielding case 102, thus the manufacturing process of the power socket is simplified.

The assembly of the power socket in the first embodiment as shown in FIG. 8 include the steps of: passing the grounding contact 131 through the square hole at the first end 155 of the rigid connector 151, covering the shielding case body 121 to the second body 113 of the insulating body 101, connecting the connecting portion 122 to the back plate 112, and welding or riveting the first end 155 of the rigid connector 151 onto the grounding contact 131.

The power socket in the first embodiment of the invention uses the rigid connector 151 to take place of the conventional flexible connecting wire. So, the connection between the grounding contact 131 of the power socket and the protective grounding pin 100 of the power supply casing 200 is simplified, the processes such as hook-welding and bundling, selecting and sleeving the PVC tube are omitted, and thereby the manufacturing process of the power socket is simplified. Meanwhile, there is no short circuit or interference between the rigid connector 151 and other elements, and the additional protection can be omitted. After that, the riveting connection or the welding connection between the rigid connector 151 and the grounding contact 131 also eliminates the potential safety hazard of the hook-welding.

The power socket in the second embodiment of the invention is illustrated hereinafter.

Figure 9:
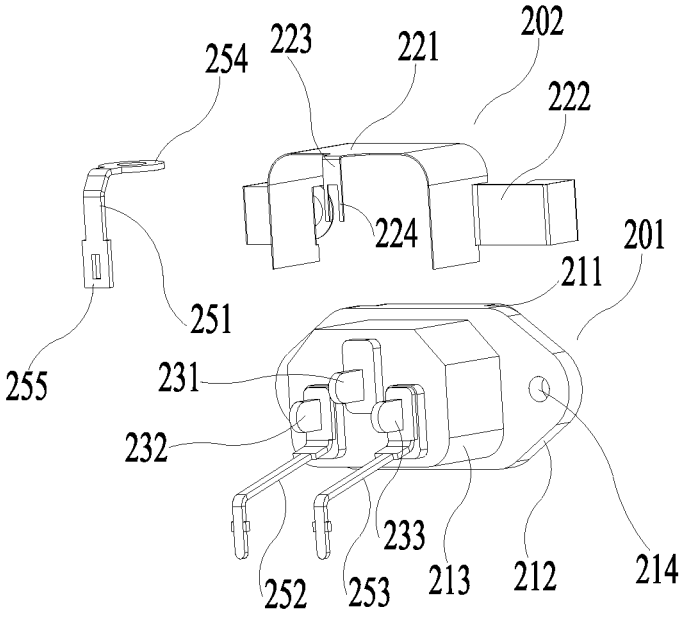
FIG. 9 is an exploded perspective view showing the power socket in the second embodiment of the invention.

As shown in FIG. 9, the power socket in the second embodiment includes an insulating body 201, input end contacts (not shown), output end contacts 231, 232, 233 and a shielding case 202. The output end contact 231, also called the grounding contact, is grounded. The output end contacts 232 and 233 are connected to the circuit board in the power supply through the connectors 252 and 253. The shielding case 202 includes an inverted U-shaped shielding case body 221 and two connecting portions 222 located at two sides of the shielding case body 221.

The insulating body 201 includes a back plate 212, a first body 211 and a second body 213. Screw holes 214 are defined at two ends of the back plate 212 for fixing the power socket to the power supply casing.

The power socket of the second embodiment is the same as that of the first embodiment in some parts, such as disposition form of the input end contacts and the output end contacts 231, 232 and 233, the relative positions between the components in the insulating body 201, the connection form between the grounding contact 231 and the protective grounding pin 100 of the power supply casing 200, the selection of the connectors 252 and 253, the extending direction of the rigid connector 251 and the beneficial effects thereof, which are not described in detail herein for concise purpose.

As shown in FIG. 9, in the power socket of the second embodiment differs from the first embodiment in that the grounding contact 231 is connected to the protective grounding pin 100 of the power supply casing 200 through the rigid connector 251 which is integrated with the shielding case 202. As shown in FIG. 9, a extending portion 223 protrudes from the middle front portion of the shielding case body 221 and bends outwards and downwards, and an inverted U-shaped portion 224 is defined at the end of the extending portion 223 to be welded to the grounding contact 231.

The first end 225 and the second end 254 of the rigid connector 251 are vertical to each other, and the first end 255 is provided with a square hole for connecting to the grounding contact 131. The second end 254 is provided with a round hole for connecting to the protective grounding pin 100 of the power supply casing 200 through screws.

The assembly of the power socket in the second embodiment of the invention, as shown in FIG. 9, includes the steps of: welding the grounding contact 131 and the extending portion 223, passing the grounding contact 231 through the square hole of the welding-integrated combination of rigid connector 251 and extending portion 223, covering the shielding case body 221 to the second body 213 of the insulating body 201, connecting the back plate 212 and the connecting portion 222, and then welding or riveting the first end 255 of the rigid connector 251 with the grounding contact 231.

The power socket in the third embodiment of the invention is illustrated hereinbelow.

Figure 10:
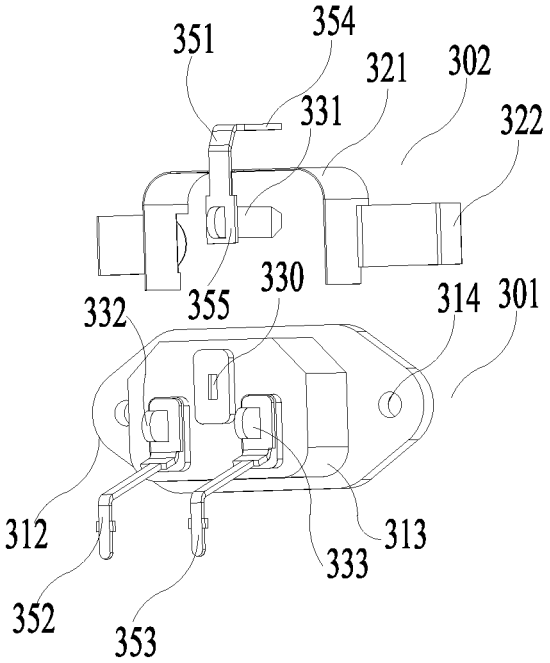
FIG. 10 is an exploded perspective view showing the power socket in the third embodiment of the invention.
Figure 11:
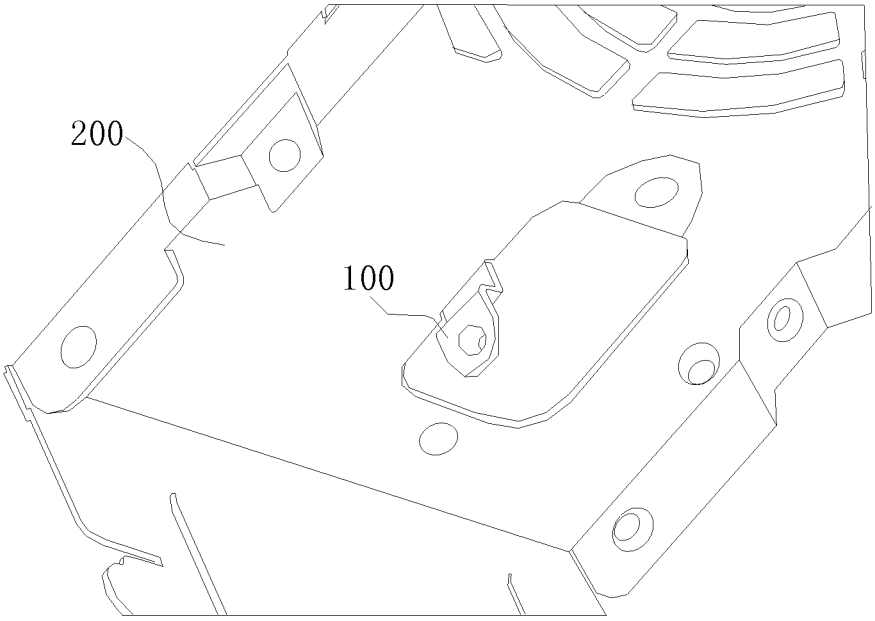
FIG. 11 is a perspective view showing the protective grounding pin and the power supply casing.

As shown in FIG. 10, the power socket in the third embodiment includes an insulating body 301, input end contacts (not shown), output end contacts 331, 332, 333 and a shielding case 302. The output end contact 331, also called the grounding contact, is grounded. The output end contacts 332 and 333 are connected to the circuit board in the power supply through the connector 352 and 353. The shielding case 302 includes an inverted U-shaped shielding case body 321 and two connecting portions 322 located at two sides of the shielding case body 321.

The insulating body 301 includes a back plate 312, a first body 311 and a second body 313. Screw holes 314 are defined at two ends of the back plate 312 for fixing the power socket to the power supply casing.

The power socket of the third embodiment is the same as that of the first and second embodiment in some parts, such as the distribution and disposition form of the input end contacts and the output end contacts 331, 332 and 333, the relative positions between the components in the insulating body 301, the connection form between the grounding contact 331 and the protective grounding pin 100 of the power supply casing 200, the selection of the connectors 352 and 353, the extending direction of the rigid connector 351 and the beneficial effects, which are not described in detail herein for concise purpose.

As shown in FIG. 10, the first end 325 and the second end 335 of the rigid connector 351 are vertical to each other. The first end 355 is provided with a square hole for connecting to the grounding contact 331. The second end 354 is provided with a round hole for connecting to the protective grounding pin 100 of the power supply casing 200 via screws. As shown in FIG. 10, the power socket in the third embodiment differs from the second embodiment in that the grounding contact 331, the rigid connector 351 and the shielding case 302 are integrated with each other. The connection between the shielding case 302 and the rigid connector 351 is the same as that between the shielding case 102 and the rigid connector 151 in the first embodiment. As shown in FIG. 10, the grounding contact 331 may be welded to the square hole at the first end 355 of the rigid connector 351.

The assembly of the power socket in the third embodiment of the invention, as shown in FIG. 10, includes the steps of disposing the grounding contact 331 to an assembling hole 330 of the second body 313, covering the shielding case body 321 to the second body 313 of the insulating body 301, connecting the back plate 312 and the connecting portion 322 to finish the assembling. The power socket in the third embodiment can be very quickly assembled.

Although the invention has been described as above in reference to several typical embodiments, it is to be understood that the terms used therein are just illustrative and exemplary rather than restrictive. Since the invention can be applied in various forms without departing from the spirit or principle of the invention, it is to be understood that the abovementioned embodiments will not be limited to any specific details mentioned above, rather, they should be construed broadly in the spirit or concept of the invention defined by the appended claims. Therefore, the present invention aims to cover all the modifications or variations falling within the protection scope defined by the appended claims.

What is claimed is:

1. A power socket, disposed on a power supply casing of an electronic device for providing power for the electronic device through a power cord, wherein the power socket comprises:

an insulating body;

three input end contacts, disposed at first side of the insulating body;

three output end contacts including a grounding contact, disposed at second side of the insulating body, the other two output end contacts being connected to the circuit board through connectors, respectively, for supplying power to the electronic device; and a rigid connector, connected between the grounding contact and a protective grounding pin of the power supply casing, wherein a first end of the rigid connector is connected to the grounding contact, and a second end of the rigid connector is connected to the protective grounding pin of the power supply casing.

2. The power socket according to claim 1, further comprising a shielding case covering the second side of the insulating body.

3. The power socket according to claim 2, wherein the rigid connector and the shielding case are integrated with each other.

4. The power socket according to claim 2, wherein the rigid connector and the grounding contact are integrated with each other.

5. The power socket according to claim 2, wherein the grounding contact, the rigid connector and the shielding case are integrated with each other.

6. The power socket according to claim 1, wherein the rigid connector is welded or riveted to the grounding contact in a welding mode or a rivet connecting mode.

7. The power socket according to claim 1, wherein the rigid connector and the shielding case are made of tinplate and the grounding contact is made of copper.

8. An electronic device, comprising a power socket disposed on a power supply casing of the electronic device for providing power for the electronic device through a power cord, wherein the power socket comprises:

an insulating body;

three input end contacts, disposed at first side of the insulating body;

three output end contacts including a grounding contact, disposed at second side of the insulating body, the other two output end contacts being connected to the circuit board through connectors, respectively, for supplying power to the electronic device; and a rigid connector, connected between the grounding contact and a protective grounding pin of the power supply casing, wherein a first end of the rigid connector is connected to the grounding contact, and a second end of the rigid connector is connected to the protective grounding pin of the power supply casing.

9. The electronic device according to claim 8, further comprising a shielding case covering the second side of the insulating body.

10. The electronic device according to claim 9, wherein the rigid connector and the shielding case are integrated with each other.

11. The electronic device according to claim 9, wherein the rigid connector and the grounding contact are integrated with each other.

12. The electronic device according to claim 9, wherein the grounding contact, the rigid connector and the shielding case are integrated with each other.

13. The electronic device according to claim 8, wherein the rigid connector is welded or riveted to the grounding contact in a welding mode or a rivet connecting mode.

14. The electronic device according to claim 8, wherein the rigid connector and the shielding case are made of tinplate and the grounding contact is made of copper.

* * * * *